United States Patent [19]

Smeelen

[11] Patent Number: 4,622,495

[45] Date of Patent: Nov. 11, 1986

[54] ELECTRODELESS DISCHARGE LAMP WITH RAPID LIGHT BUILD-UP

[75] Inventor: Theodorus J. H. Smeelen, Eindhoven, Netherlands

[73] Assignee: U.S. Philips Corporation, New York, N.Y.

[21] Appl. No.: 587,792

[22] Filed: Mar. 9, 1984

[30] Foreign Application Priority Data

Mar. 23, 1983 [NL] Netherlands ..... 8301032

[51] Int. Cl.[4] ..... H05B 41/16; H05B 41/24

[52] U.S. Cl. ..... 315/248; 313/490; 313/547; 313/550

[58] Field of Search ..... 315/248, 112, 117; 313/490, 547, 550

[56] References Cited

U.S. PATENT DOCUMENTS

| | | | |
|---|---|---|---|
| 3,504,215 | 3/1970 | Evans | 313/490 |
| 3,526,803 | 9/1970 | Wainio et al. | 313/490 |
| 3,534,212 | 10/1970 | Evans | 313/490 |
| 4,093,889 | 6/1978 | Bloem et al. | 313/490 |
| 4,119,889 | 10/1978 | Hollister | 315/248 |
| 4,262,231 | 4/1981 | Anderson et al. | 313/490 |
| 4,437,041 | 3/1984 | Roberts | 315/248 |

*Primary Examiner*—David K. Moore
*Assistant Examiner*—M. Razavi
*Attorney, Agent, or Firm*—David R. Treacy

[57] ABSTRACT

An electrodeless fluorescent lamp having a core of magnetic material surrounded by a coil for producing a high-frequency magnetic field in a lamp vessel surrounding the core and coil. An amalgam holder is located in the vessel, in the region surrounding the core where the electric discharge is formed so that the amalgam is heated directly by the discharge. Substantially all the mercury contained in this amalgam is released quickly after the lamp is turned on, so that the light output rises rapidly.

11 Claims, 1 Drawing Figure

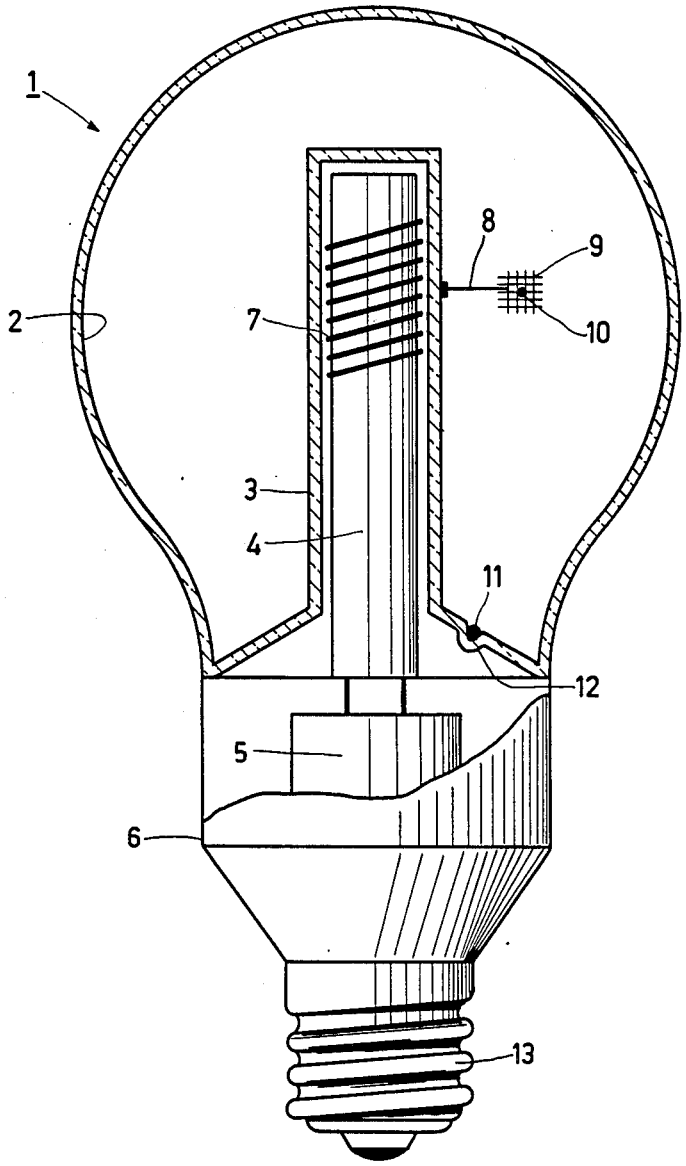
1
2
3
4
5
6
7
8
9
10
11
12
13

ELECTRODELESS DISCHARGE LAMP WITH RAPID LIGHT BUILD-UP

BACKGROUND OF THE INVENTION

The invention relates to an electrodeless discharge lamp comprising a lamp vessel which is sealed in a vacuum-tight manner and is filled with mercury and a rare gas and more particularly to such a lamp having a core of magnetic material in which a high-frequency magnetic field can be induced by an electronic ballast, and a coil wound around the core, to produce an electric discharge in the lamp vessel. A holder with an amalgam is disposed in the lamp vessel to act as a mercury vapor source. Such a lamp is known from the British published patent application No. 2,039,138 A.

In the lamp described in this published patent application, the amalgam is located at a comparatively cool area in the lamp vessel, in order to stabilize the mercury vapor pressure at a value of approximately 1 Pa during operation of the lamp. At a mercury vapor pressure of approximately 1 Pa, the conversion of electric energy into ultraviolet radiation (mainly resonance radiation of mercury having a wavelength of 254 nm) is optimized. The amalgam in this known lamp is preferably provided in a holder which is located in the exhaust tube of the lamp vessel.

One of the problems which arise in an electrodeless lamp, especially in such a lamp whose lamp vessel is provided with an amalgam regulating the mercury vapor pressure, is that especially after starting a comparatively long period of time elapses before the correct optimum vapor pressure is reached. Of course, the light output during this time is adversely affected.

SUMMARY OF THE INVENTION

The invention has for its object to provide an electrodeless gas discharge lamp with a rapid build-up of mercury pressure after starting, so full light output is reached quickly.

According to the invention, in an electrodeless gas discharge lamp of the kind described above the holder with the amalgam is located at the level of the coil wound around the core, at a place between the core and the wall of the vessel selected so that the holder is situated in the discharge produced immediately after the lamp has been switched on and the amalgam is immediately heated directly by the discharge. The amount and type of amalgam is chosen so that in the stable operating condition the holder contains essentially only amalgam-producing metal, substantially without any remaining mercury.

In the lamp according to the invention, the holder is located at an area in which the intensity of the discharge during operation is comparatively high. The amalgam is thus heated rapidly, so that after the lamp has been switched on, substantially the whole quantity of mercury is released from the amalgam and is taken up by the discharge. A comparatively high light output is obtained a short time after the lamp has been switched on.

The lamp vessel of the electrodeless lamp is shaped so that during operation of the lamp the discharge is shaped as a toroid around the core. In order to obtain an optimum light output, at the area of the winding coil there is a comparatively large distance between the core and the outer wall of the lamp vessel. The mercury released from the amalgam remains in the discharge for a comparatively long time, so that substantially no condensation of mercury occurs on an adjacent cool part of the wall of the lamp envelope, nor the other core itself or on the parts of the wall of the lamp vessel located around the core. The amalgam should not be disposed on the core itself nor on a wall part located around the core. It has been found that the temperature of these parts is too low to obtain the desired effect. This is especially true if the core is provided with a heat-conducting body (see Netherlands patent application No. 8104223, to which U.S. Pat. No. 4,536,675 corresponds).

In a practical embodiment of the lamp according to the invention, the holder is secured on a supporting member which is secured to the wall of the lamp vessel. The holder then remains fixed during operation of the lamp in its position at the center of the discharge.

In the lamp according to the invention, the core of magnetic material is preferably rod-shaped and is located in a tubular indentation in the wall of the lamp vessel, the supporting member being secured to the wall of the indentation. During the manufacture of the lamp, the supporting member (which preferably takes the form of a wire) can be provided in a comparatively simple manner. The supporting member is secured to the wall by means of, for example, glass enamel.

The holder for the amalgam has, for example, the form of a plate-shaped body. The amalgam is preferably contained in a holder which is in the form of a wire network of a metal or an alloy (such as a chromium-nickel-iron alloy). Such a wire network can be manufactured in a simple manner and has a comparatively low heat capacity, as a result of which the heat produced by the discharge is taken up substantially completely by the amalgam, mercury then being released readily.

The amalgam present in or on the holder preferably consists of a mercury alloy, from which, when the lamp is switched on, mercury is released readily upon heating. Favorable results are obtained with an amalgam consisting of indium and mercury.

A lamp according to the invention may have such a light output, shape, and color rendition that it is suitable to serve as an alternative for incandescent lamps for general illumination purposes, as used, for example, in private houses.

The invention will be described more fully with reference to the drawing.

BRIEF DESCRIPTION OF THE DRAWING

The sole FIGURE is a diagrammatic side view, partly sectional and partly in elevation, of an embodiment of an electrodeless lamp according to the invention.

DESCRIPTION OF THE PREFERRED EMBODIMENT

The lamp shown in the drawing comprises a glass lamp vessel 1 which is sealed in a vacuum-tight manner and is filled with a quantity of mercury and a rare gas, such as krypton. Further, a layer 2 of luminescent material is disposed on the inner wall of the lamp vessel for converting the ultraviolet radiation produced in the lamp envelope into visible light. A rod-shaped core 4 of magnetic material is arranged in a tubular indentation 3 in the wall of the lamp vessel. An electric supply unit 5, such as an electronic oscillator and ballast, is disposed in a housing 6 (preferably of synthetic material) which is partly of conical form and is provided with a sleeve 13. The unit 5 includes a high-frequency magnetic field in the core during operation of the lamp by means of a coil 7 connected to the unit (not visible in the drawing) and wound around this core. An electric discharge is then produced in the lamp vessel.

At the level of the coil 7, a wire-shaped supporting member 8 is secured to the wall of the indentation 3. At a predetermined distance from the outer wall of the lamp envelope and the core, a holder 9 which is in the form of a wire network of a metal alloy (such as chromium-nickel-iron), in which an amalgam 10 is contained is attached to the member 8. In the drawing, the holder is shown at the same level as the coil. However, in another embodiment, the holder may alternatively be located in a horizontal plane transverse to the core and lamp axis, which lies just below or just above the coil (for example, approximately 10% of the coil length value). After the lamp has been switched on, the holder 9 is located in the discharge and is directly heated by the temperature (approximately 300° C.) of the discharge. As a result the holder will become substantially free of mercury in the stable operating condition of the lamp. Substantially the whole quantity of mercury is released from the amalgam, whereby essentially only amalgam-producing metal (such as indium or an alloy of indium and bismuth) remains in the holder.

The holder 9 is located approximately halfway between the outer wall of the lamp vessel and the wall part 3 (preferably 1/5 to 4/5 of this distance). This location prevents the mercury released from the amalgam in the holder from being condensed on the wall immediately after the amalgam is heated. When the lamp is switched off, the mercury returns to the holder, an amalgam then again being formed.

In the embodiment shown, the lamp vessel contains a second amalgam 11 for regulating the mercury vapor pressure during the operation of the lamp. This amalgam is disposed in a recess 12 at a comparatively cool area in the inner wall. In a practical embodiment, the amalgam 11 consists of an alloy of lead, tin, bismuth and mercury (see U.S. Pat. No. 4,093,889).

In a practical embodiment of a lamp of the kind described above, the glass lamp vessel has a diameter of approximately 65 mm and a length of approximately 70 mm. Before the lamp is switched on, the amalgam 10 contains approximately 1.5 mg of In and 2 mg of Hg. The lamp vessel also contains krypton at a pressure of approximately 70 Pa. In this embodiment, the luminescent layer 2 consists of a mixture of two phosphors, for example green luminescing terbium-activated cerium-magnesium aluminate and red luminescing yttrium oxide activated by trivalent europium. The magnetic material of the rod-shaped core consists of a ferrite having a relative permeability of approximately 200 ("Philips 4M2" ferrite). The coil 7 comprises approximately ten turns of copper wire (diameter 0.5 mm, L=approximately 4.5 $\mu$H). The electric supply unit 5 includes a high-frequency oscillator having a frequency of approximately 3 MHz. A heat-conducting rod (not visible in the drawing) according to U.S. Pat. No. 4,536,675 is arranged in the core 4 for cooling it. The amalgam (180 mg) regulating the vapor pressure consists of an alloy of Pb-Sn-Bi-Hg (ratio in % by weight 20:34:46:3).

When a power (inclusive of the supply unit) of approximately 15 W was supplied to the lamp, the luminous flux was 900 lumen.

What is claimed is:

1. An electrodeless discharge lamp, comprising:

a lamp vessel, sealed in a vacuum-tight manner, and containing a filling of mercury and a rare gas, a core of magnetic material, and a coil wound around the core, for inducing a high-frequency magnetic field in the core upon energization by an electric supply unit, so as to produce an electric discharge within the lamp envelope, and a holder containing an amalgam, disposed within the lamp vessel, characterized in that the holder is disposed within the vessel at a location at a given distance outward from the core and from the wall, where the discharge is produced by the high-frequency magnetic field, such that the holder is located in the discharge and the amalgam is heated directly by the discharge, and the amalgam is selected such that during operation of the lamp the holder contains essentially only amalgam-producing metal, and is substantially free of mercury.

2. An electrodeless discharge lamp as claimed in claim 1, characterized by comprising a supporting member secured to the wall of the lamp vessel, the holder being carried on the supporting member.

3. A lamp as claimed in claim 1, characterized by comprising a supporting member for the holder, and the core of magnetic material is an elongated rod located in a tubular indentation in the wall of the lamp vessel, the supporting member being secured to the wall of the indentation.

4. A lamp as claimed in claim 3, characterized in that the supporting member is shaped as a wire extending radially from the core.

5. A lamp as claimed in claim 2, characterized in that the supporting member is shaped as a wire extending radially from the core.

6. A lamp as claimed in any one of claims 1–5, characterized in that the holder is formed as a wire network of a metal or an alloy.

7. A lamp as claimed in claim 6, characterized in that the amalgam contains indium.

8. A lamp as claimed in claim 7, characterized by comprising a second amalgam disposed within the lamp vessel, for regulating mercury vapor pressure during operation.

9. A lamp as claimed in claim 6, characterized by comprising a second amalgam disposed within the lamp vessel, for regulating mercury vapor pressure during operation.

10. A lamp as claimed in any one of claims 1–5, characterized by comprising a second amalgam disposed within the lamp vessel, for regulating mercury vapor pressure during operation.

11. A lamp as claimed in any one of claims 1–5, characterized in that the amalgam contains indium.

* * * * *